US008882482B2

(12) United States Patent
Mitsui et al.

(10) Patent No.: US 8,882,482 B2
(45) Date of Patent: Nov. 11, 2014

(54) COMPRESSOR

(75) Inventors: Tsubasa Mitsui, Kariya (JP); Shinichi Sato, Kariya (JP); Kazuo Kobayashi, Kariya (JP); Akio Saiki, Kariya (JP); Akihiro Nakashima, Kariya (JP); Shinsuke Asou, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 271 days.

(21) Appl. No.: 13/557,594

(22) Filed: Jul. 25, 2012

(65) Prior Publication Data

US 2013/0034461 A1 Feb. 7, 2013

(30) Foreign Application Priority Data

Aug. 3, 2011 (JP) ..... 2011-170342

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/04*** | (2006.01) |
| ***F04C 15/00*** | (2006.01) |
| ***F04C 27/00*** | (2006.01) |
| ***F04C 29/02*** | (2006.01) |
| ***F04C 29/04*** | (2006.01) |
| *F04C 18/02* | (2006.01) |

(52) U.S. Cl.

CPC ..... *F04C 29/028* (2013.01); *F04C 18/0215* (2013.01); *F04C 2240/809* (2013.01)

USPC ..... 418/55.6; 418/83; 418/97; 418/100; 95/269

(58) Field of Classification Search

CPC ..... F04C 29/026; F04C 29/02; F04C 29/028; F04C 2240/809

USPC ..... 418/55.6, 83, DIG. 1, 97, 100; 417/312, 417/410.5, 269; 95/269, 271; 55/459.1, 55/460, 447

See application file for complete search history.

(56) References Cited

U.S. PATENT DOCUMENTS 4,321,019 A * 3/1982 Degawa et al. ..... 417/269
5,718,566 A 2/1998 Ikeda et al.

(Continued)

FOREIGN PATENT DOCUMENTS

CN 1683794 A 10/2005
EP 1418337 A2 5/2004

(Continued)

OTHER PUBLICATIONS

Chinese Office Action with its English translation for Chinese Patent Application No. 201210270289.X mailed on Aug. 5, 2014.

*Primary Examiner* — Kenneth Bomberg
*Assistant Examiner* — Deming Wan
(74) *Attorney, Agent, or Firm* — Yoshida & Associates, LLC

(57) ABSTRACT

A compressor has auxiliary and main oil reservoir chambers that retain lubricant oil that is separated from refrigerant in an oil separation chamber. A part of the auxiliary oil reservoir chamber is defined by a peripheral wall of the oil separation chamber. An introducing passage for introducing lubricant oil in the oil separation chamber to the auxiliary oil reservoir chamber is formed in the peripheral wall. The inlet of the introducing passage opens to the oil separation chamber on the inner surface of the peripheral wall. The outlet of the introducing passage opens to the auxiliary oil reservoir chamber. The main oil reservoir chamber is located below the auxiliary oil reservoir chamber in the direction of gravity. A drain port for draining lubricant oil in the auxiliary oil reservoir chamber to the main oil reservoir chamber is formed in a bottom wall of the auxiliary oil reservoir chamber.

5 Claims, 4 Drawing Sheets

(56) References Cited

U.S. PATENT DOCUMENTS

| | | | | |
|---|---|---|---|---|
| 7,438,536 | B2 | 10/2008 | Ito | |
| 2002/0134101 | A1 | 9/2002 | Gennami et al. | |
| 2002/0136653 | A1* | 9/2002 | Gennami et al. | 418/55.6 |
| 2005/0226756 | A1 | 10/2005 | Ito | |

FOREIGN PATENT DOCUMENTS

| | | | |
|---|---|---|---|
| JP | 05-240158 | A | 9/1993 |
| JP | 2005-171860 | A | 6/2005 |
| JP | 2005-320873 | A | 11/2005 |
| JP | 2008-069698 | A | 3/2008 |

* cited by examiner

COMPRESSOR

BACKGROUND OF THE INVENTION

The present invention relates to a compressor including a compressing portion, which is provided in a housing and compresses refrigerant, an oil separation chamber, which receives refrigerant from the compressing portion and has a peripheral wall for causing the refrigerant to swirl to separate lubricant oil mixed in the refrigerant, and an oil reservoir chamber for storing the lubricant oil separated from the refrigerant. Specifically, the present invention relates to a compressor that is structured to supply lubricant oil in the oil reservoir chamber to the refrigerant suction-side structure of the compressing portion.

As an example of such a compressor, FIG. 5 shows a compressor 80 disclosed in Japanese Laid-Open Patent Publication No. 2005-171860. The compressor 80 includes a housing 81, a refrigerant discharge chamber 82 communicating with a compressing portion (not shown), a refrigerant outlet 83 communicating with the refrigerant discharge chamber 82, and an oil separation chamber 84. The compressor 80 accommodates in the housing 81 the oil separation chamber 84 formed in a refrigerant passage between the refrigerant discharge chamber 82 and the refrigerant outlet 83. The oil separation chamber 84 is defined by a cylindrical inner wall 85. A cylindrical separation pipe 86 is arranged in the oil separation chamber 84. The separation pipe 86 has an upper end connected to the refrigerant outlet 83 and a lower end that is open at a position separated from a bottom wall 84*b* of the oil separation chamber 84.

A pair of communication holes 87 is formed in an upper part of the oil separation chamber 84 that is closer to the refrigerant discharge chamber 82. An introducing hole 84*a* is formed at a center of the bottom wall 84*b* of the oil separation chamber 84. An oil reservoir chamber 88 is formed below the oil separation chamber 84. The oil reservoir chamber 88 is divided into a first oil reservoir chamber 90 and a second oil reservoir chamber 91 by a partition 89. The first and second oil reservoir chambers 90, 91 have at the lower portions cutouts 90*a*, 91*a*, respectively. The cutouts 90*a*, 91*a* are connected to each other by a communication passage 92. The first oil reservoir chamber 90 is connected to the oil separation chamber 84 by the introducing hole 84*a*. The second oil reservoir chamber 91 is connected to the refrigerant suction-side structure of the compressing portion.

After being delivered to the oil separation chamber 84 from the refrigerant discharge chamber 82 via the communication holes 87, refrigerant swirls along the inner wall 85 of the oil separation chamber 84. At that time, the refrigerant is discharged from the refrigerant outlet 83 to the outside of the compressor 80 via the lower end of the separation pipe 86. On the other hand, lubricant oil in the refrigerant collects on the inner wall 85 to be separated from the refrigerant. The separated lubricant oil is introduced to the first oil reservoir chamber 90 via the introducing hole 84*a* of the oil separation chamber 84. After being introduced to the first oil reservoir chamber 90, the lubricant oil moves to the second oil reservoir chamber 91 via the cutouts 90*a*, 91*a* and the communication passage 92 and is then supplied to the refrigerant suction-side structure of the compressing portion.

Thus, in the compressor 80, even if the momentum of lubricant oil from the oil separation chamber 84 disturbs the surface of the oil in the first oil reservoir chamber 90, the oil surface in the second oil reservoir chamber 91 is not disturbed. This prevents refrigerant in gaseous state from being supplied to the refrigerant suction-side structure. Therefore, the compressor 80 is capable of steadily supplying lubricant oil to the refrigerant suction-side structure.

As described above, in the compressor 80 of FIG. 5, lubricant oil mixed in refrigerant is separated from the refrigerant by collecting on the inner wall 85 of the oil separation chamber 84. The separated lubricant oil flows from the inner wall 85 and along the bottom wall 84*b* of the oil separation chamber 84 and introduced to the oil reservoir chamber 88 via the introducing hole 84*a* of the bottom wall 84*b*. Since the lubricant oil in the oil separation chamber 84 flows along the bottom wall 84*b*, it takes time for the lubricant oil to be introduced to the oil reservoir chamber 88. While flowing along the bottom wall 84*b*, the lubricant oil might be carried away to the outside of the compressor 80 together with refrigerant.

SUMMARY OF THE INVENTION

Accordingly, it is an object of the present invention to provide a compressor that is capable of suppressing disturbance of the oil surface in an oil reservoir chamber and lubricant oil flow from an oil separation chamber to the outside.

To achieve the foregoing objective and in accordance with one aspect of the present invention, a compressor that includes a compressing portion, an oil separation chamber, an auxiliary oil reservoir chamber, and a main oil reservoir chamber is provided. The compressing portion is located in a housing to compress refrigerant. To the oil separation chamber, refrigerant is introduced from the compressing portion. The oil separation chamber has a peripheral wall for causing refrigerant to swirl to separate lubricant oil mixed in the refrigerant. The auxiliary oil reservoir chamber and the main oil reservoir chamber retain lubricant oil that is separated from refrigerant. A part of the auxiliary oil reservoir chamber is defined by the peripheral wall of the oil separation chamber. An introducing passage for introducing lubricant oil in the oil separation chamber to the auxiliary oil reservoir chamber is formed in the peripheral wall. The introducing passage has an inlet located at one end and an outlet located at the other end. The inlet of the introducing passage opens to the oil separation chamber on an inner surface of the peripheral wall. The outlet of the introducing passage opens to the auxiliary oil reservoir chamber. The main oil reservoir chamber is located below the auxiliary oil reservoir chamber in the direction of gravity. A drain port is formed in a bottom wall of the auxiliary oil reservoir chamber. The drain port drains lubricant oil in the auxiliary oil reservoir chamber to the main oil reservoir chamber, and lubricant oil in the main oil reservoir chamber is supplied to a suction-side structure of the compressing portion.

Other aspects and advantages of the invention will become apparent from the following description, taken in conjunction with the accompanying drawings, illustrating by way of example the principles of the invention.

BRIEF DESCRIPTION OF THE DRAWINGS

FIG. 2(*b*) is a cross-sectional view taken along line IIb in FIG. 1;

DETAILED DESCRIPTION OF THE PREFERRED EMBODIMENTS

A scroll compressor 10 according to one embodiment of the present invention will now be described with reference to FIGS. 1 to 4.

Figure 1:
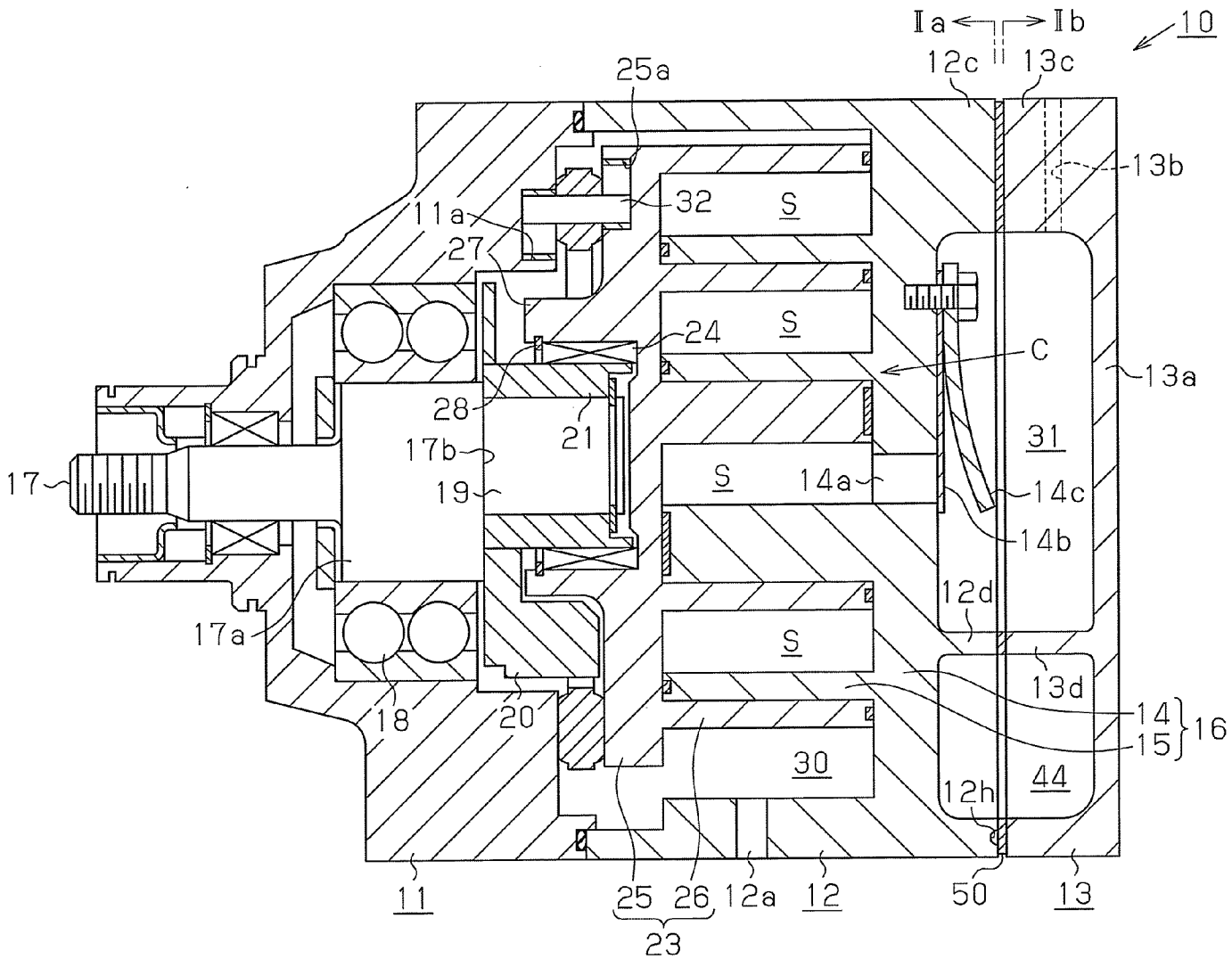
FIG. 1 is a cross-sectional view illustrating a compressor according to one embodiment of the present invention.
Figure 2A:
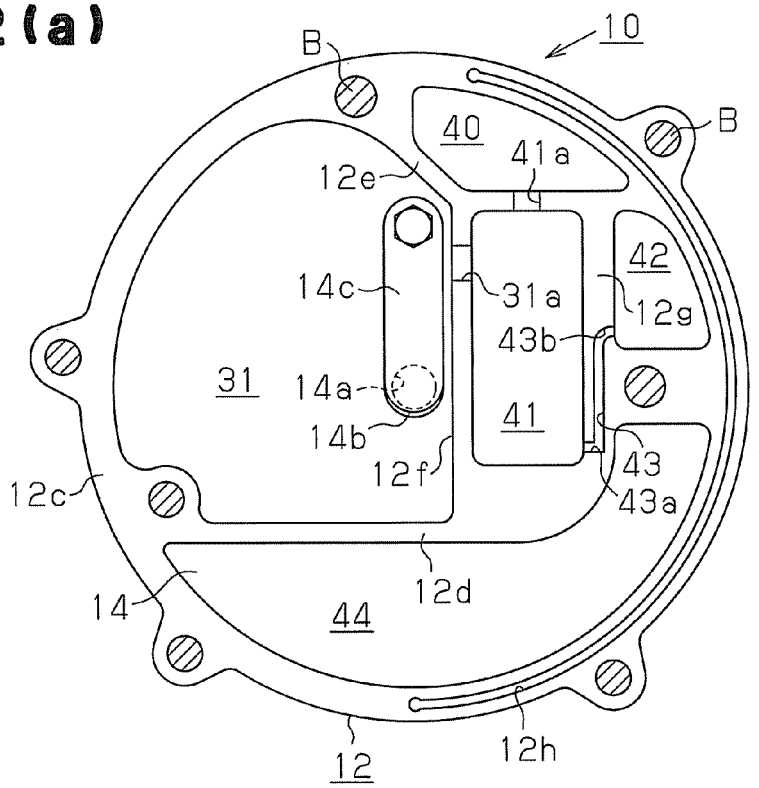
FIG. 2(*a*) is a cross-sectional view taken along line IIa in FIG. 1.
Figure 2B:
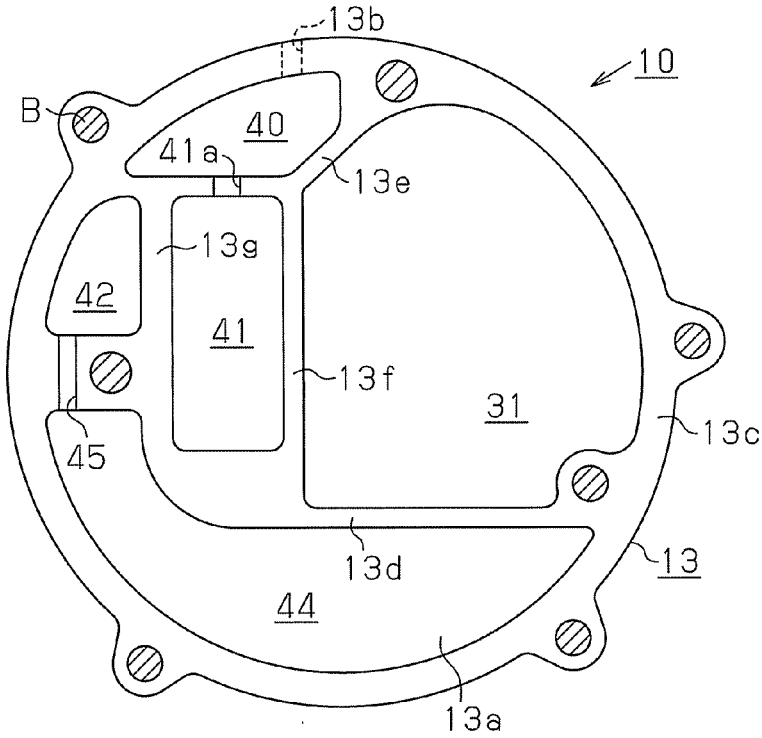

As shown in FIGS. 1 and 2, the housing of the scroll compressor 10 is formed by coupling a front housing member 11 to one end of a center housing member (shell) 12 and coupling a rear housing member 13 to the other end of the center housing member 12. The front housing member 11, the center housing member 12, and the rear housing member 13 are fastened together using fastener bolts B. In the present embodiment, the center housing member 12, the front housing member 11, and the rear housing member 13 function as housing forming members.

As shown in FIG. 1, the housing of the scroll compressor 10 accommodates in it a scroll-type compressing portion C for compressing refrigerant. Specifically, the center housing member 12 is formed as a cylinder that has a closed end and an opening facing the front housing member 11. The fixed scroll 16, which is part of the compressing portion C, is formed in the center housing member 12. The fixed scroll 16 is formed by a fixed base plate 14, which forms a closed end of the center housing member 12, and a fixed volute wall 15, which extends from the fixed base plate 14 and within the center housing member 12.

The front housing member 11 rotationally supports a large diameter portion 17*a* of a rotary shaft 17 with a radial bearing 18. The large diameter portion 17*a* of the rotary shaft 17 has an eccentric shaft 19, which is integrally formed with an end face 17*b* facing the fixed scroll 16. The axis of the eccentric shaft 19 is offset from the axis of the rotary shaft 17.

The eccentric shaft 19 supports a balance weight 20 and a bushing 21 such that the balance weight 20 and the bushing 21 are rotational relative to the eccentric shaft 19. The bushing 21 supports a orbiting scroll 23, which forms part of the compressing portion C, by means of a needle bearing 24 such that the orbiting scroll 23 faces the fixed scroll 16. The orbiting scroll 23 is rotational relative to the bushing 21. The orbiting scroll 23 is formed by an orbiting base plate 25, which faces the fixed base plate 14, and an orbiting volute wall 26, which extends from the orbiting base plate 25 to mesh with the fixed volute wall 15.

A compression chamber S having a variable volume is defined between the fixed base plate 14 of the fixed scroll 16 and the orbiting base plate 25 of the orbiting scroll 23. A discharge port 14*a*, which communicates with the compression chamber S, is formed in the fixed base plate 14. The discharge port 14*a* is selectively opened and closed by a discharge valve flap 14*b*, which is fixed to the fixed base plate 14. A retainer 14*c* fixed to the fixed base plate 14 limits the opening degree of the discharge valve flap 14*b*.

The discharge port 14*a* communicates with a discharge chamber 31, which is defined by the center housing member 12 and the rear housing member 13. A suction chamber 30, which is the suction-side structure of the compressing portion C, is defined between the peripheral wall of the center housing member 12 and the outermost part of the orbiting volute wall 26 of the orbiting scroll 23. That is, in the housing, the suction chamber 30 is located in a radially outer portion of the compressing portion C. A suction port 12*a*, which communicates with the suction chamber 30, is formed in the peripheral wall of the center housing member 12.

The front housing member 11 has anti-rotation holes 11*a*, which are formed in an end face that faces the radially outer portion of the orbiting base plate 25. The anti-rotation holes 11*a* are arranged in the circumferential direction of the orbiting base plate 25. The orbiting base plate 25 has anti-rotation holes 25*a*, the number of which is equal to the number of the anti-rotation holes 11*a*. The anti-rotation holes 25*a* are arranged in the circumferential direction of the orbiting base plate 25. Ends of anti-rotation pins 32 are inserted in the anti-rotation holes 11*a*, 25*a*.

As the rotary shaft 17 and the eccentric shaft 19 rotate, the orbiting scroll 23 orbit, so that refrigerant is drawn into the suction chamber 30 via the suction port 12*a* and then flows to the space between the fixed base plate 14 and the orbiting base plate 25. As the orbiting scroll 23 orbits, the circumferential surface of each anti-rotation pin 32 slides along the inner circumferential surface of the corresponding anti-rotation hole 11*a*, 25*a*. This allows the orbiting scroll 23 to orbit without rotating. As the orbiting scroll 23 orbits, the compression chamber S moves toward the inner ends of the volute walls 15, 26 of the scrolls 16, 23, while reducing its volume. Refrigerant gas that has been compressed by the reduction in the volume of the compression chamber S is discharged to the discharge chamber 31 via the discharge port 14*a*.

With reference to FIGS. 1, 2(*a*), 2(*b*) and 3, a muffler chamber 40, an oil separation chamber 41, an auxiliary oil reservoir chamber 42, and a main oil reservoir chamber 44, which are defined by coupling the center housing member 12 and the rear housing member 13 together, will now be described.

A first annular wall 12*c* extends from a peripheral edge of the fixed base plate 14 of the center housing member 12 at a position facing the rear housing member 13. A second annular wall 13*c* extends from a peripheral edge of a bottom 13*a* of the rear housing member 13 at a position facing the first annular wall 12*c*. When the center housing member 12 and the rear housing member 13 are coupled to each other, a gasket 50 is held between the center housing member 12 and the rear housing member 13, so that the gasket 50 prevents refrigerant and lubricant oil from leaking from the chambers 40, 41, 42, 44.

Figure 4:
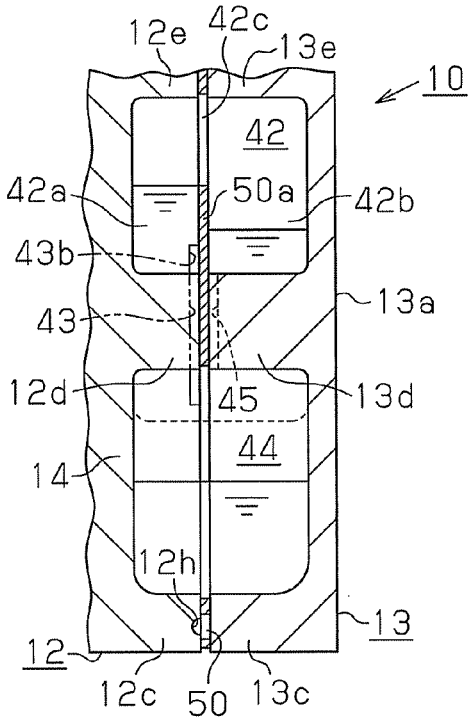
FIG. 4 is a cross-sectional view taken along line IV-IV in FIG. 3, illustrating an auxiliary oil reservoir chamber and a main oil reservoir chamber.
Figure 5:
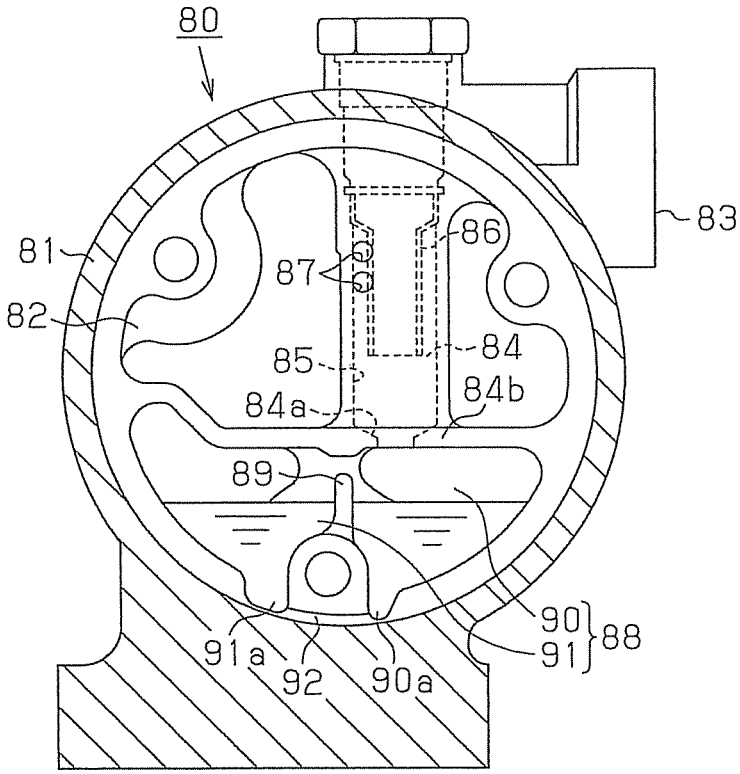
Fig.5 Prior Art
FIG. 5 is a cross-sectional view illustrating a conventional compressor.

As shown in FIGS. 2(*a*) and 2(*b*), a first dividing wall 12*d* is formed in a lower portion with respect to the direction of gravity on the fixed base plate 14. The first dividing wall 12*d* connects two points of the first annular wall 12*c*. A space surrounded by the fixed base plate 14, the first dividing wall 12*d*, and the first annular wall 12*c* forms a part of the main oil reservoir chamber 44. On the other hand, a first dividing wall 13*d* is formed in a lower portion with respect to the direction of gravity on the bottom 13*a* of the rear housing member 13. The first dividing wall 13*d* connects two points of the second annular wall 13*c*. A space surrounded by the bottom 13*a*, the first dividing wall 13*d*, and the second annular wall 13*c* forms a part of the main oil reservoir chamber 44. As shown in FIG. 4, when the center housing member 12 and the rear housing member 13 are coupled together, the two parts of the main oil reservoir chamber 44 are joined, so that the main oil reservoir chamber 44 is formed in the housing. As shown in FIG. 2(*a*), an introducing passage 12*h* is formed in the end face of the first annular wall 12*c* of the center housing member 12. The introducing passage 12*h* extends substantially halfway around the first annular wall 12*c* to connect the main oil reservoir chamber 44 and the suction chamber 30 to each other.

Figure 3:
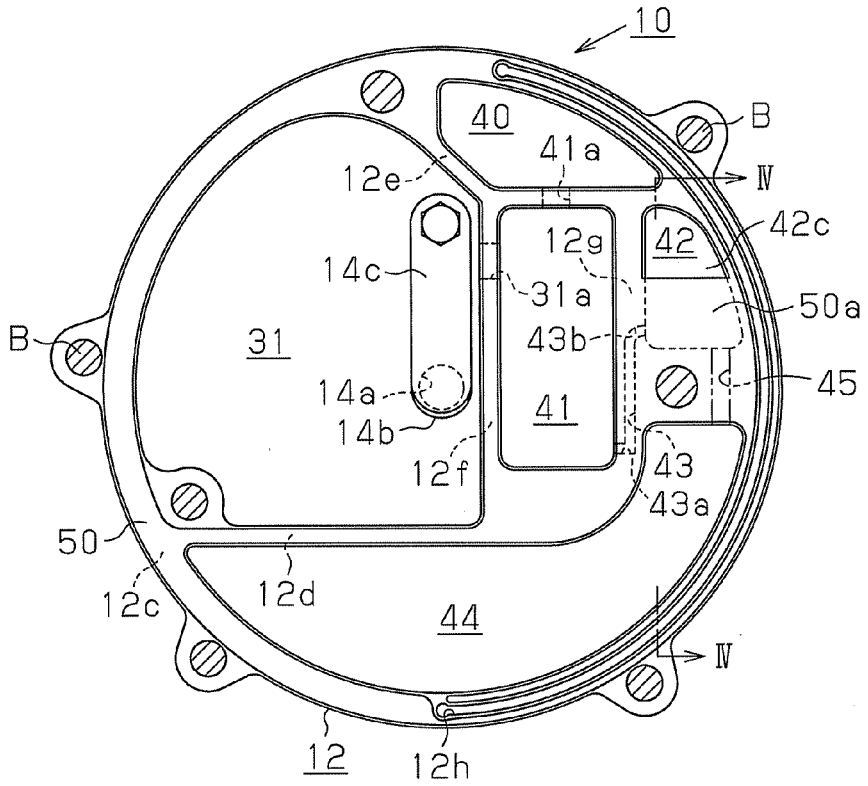
FIG. 3 is a diagram showing a gasket and the interior of the compressor shown in FIG. 1.

Further, a second dividing wall 12*e* is formed in an upper portion with respect to the direction of gravity on the fixed base plate 14. The second dividing wall 12*e* connects two points of the first annular wall 12*c*. A space surrounded by the fixed base plate 14, the second dividing wall 12*e*, and the first annular wall 12*c* forms a part of the muffler chamber 40. On the other hand, as shown in FIG. 2(*b*), a second dividing wall 13*e* is formed in an upper portion with respect to the direction of gravity on the bottom 13*a* of the rear housing member 13. The second dividing wall 13*e* connects two points of the second annular wall 13*c*. A space surrounded by the bottom 13*a*, the second dividing wall 13*e*, and the second annular wall 13*c* forms a part of the muffler chamber 40. As shown in FIG. 3, when the center housing member 12 and the rear housing member 13 are coupled together, the two parts of the muffler chamber 40 are joined, so that the muffler chamber 40 is formed in the housing. The muffler chamber 40 communicates with an outlet hole 13*b* formed in the second annular wall 13*c*, and the outlet hole 13*b* is connected to the outside.

As shown in FIG. 2(*a*), a third dividing wall 12*f* is formed on the fixed base plate 14 to extend in the direction of gravity and connect the first dividing wall 12*d* and the second dividing wall 12*e* to each other. A space surrounded by the fixed base plate 14, the first annular wall 12*c*, the first dividing wall 12*d*, the second dividing wall 12*e*, and the third dividing wall 12*f* forms a part of the discharge chamber 31. On the other hand, as shown in FIG. 2(*b*), a third dividing wall 13*f* is formed on the bottom 13*a* of the rear housing member 13 to extend in the direction of gravity and connect the first dividing wall 13*d* and the second dividing wall 13*e* to each other. A space surrounded by the bottom 13*a*, the second annular wall 13*c*, the first dividing wall 13*d*, the second dividing wall 13*e*, and the third dividing wall 13*f* forms a part of the discharge chamber 31. As shown in FIG. 1, when the center housing member 12 and the rear housing member 13 are coupled together, the two parts of the discharge chamber 31 are joined, so that the discharge chamber 31 is formed in the housing.

As shown in FIG. 2(*a*), a fourth dividing wall 12*g* is formed on the fixed base plate 14 at a position beside the third dividing wall 12*f* to connect the first dividing wall 12*d* and the second dividing wall 12*e* to each other. A space surrounded by the fixed base plate 14, the first dividing wall 12*d*, the second dividing wall 12*e*, the third dividing wall 12*f*, and the fourth dividing wall 12*g* forms a part of the oil separation chamber 41. On the other hand, as shown in FIG. 2(*b*), a fourth dividing wall 13*g* is formed on the bottom 13*a* of the rear housing member 13 at a position beside the third dividing wall 13*f* to connect the first dividing wall 13*d* and the second dividing wall 13*e* to each other. A space surrounded by the bottom 13*a*, the first dividing wall 13*d*, the second dividing wall 13*e*, the third dividing wall 13*f*, and the fourth dividing wall 13*g* forms a part of the oil separation chamber 41. As shown in FIG. 3, when the center housing member 12 and the rear housing member 13 are coupled together, the two parts of the oil separation chamber 41 are joined, so that the oil separation chamber 41 is formed in the housing.

As shown in FIG. 2(*a*), in the center housing member 12, a space surrounded by the fixed base plate 14, the first annular wall 12*c*, the first dividing wall 12*d*, and the fourth dividing wall 12*g* forms a part of the auxiliary oil reservoir chamber 42. The volume of the auxiliary oil reservoir chamber 42 is less than the volume of the main oil reservoir chamber 44. As shown in FIG. 2(*b*), in the rear housing member 13, a space surrounded by the bottom 13*a*, the second annular wall 13*c*, the first dividing wall 13*d*, and the fourth dividing wall 13*g* forms a part of the auxiliary oil reservoir chamber 42. As shown in FIG. 4, when the center housing member 12 and the rear housing member 13 are coupled together, the two parts of the auxiliary oil reservoir chamber 42 are joined, so that the auxiliary oil reservoir chamber 42 is formed in the housing.

As shown in FIG. 3, in the housing, the oil separation chamber 41 is arranged beside the discharge chamber 31. That is, the oil separation chamber 41 is located at position spaced from the discharge chamber 31 in a direction perpendicular to the direction of gravity (the vertical direction). The peripheral wall of the oil separation chamber 41 is shaped like a cylinder by combining the fixed base plate 14 of the center housing member 12, the third dividing wall 12*f*, the fourth dividing wall 12*g*, the bottom 13*a* of the rear housing member 13, the third dividing wall 13*f*, and the fourth dividing wall 13*g*. The peripheral wall of the oil separation chamber 41 refers to a combination of the walls defining the oil separation chamber 41 except for the upper wall (the second dividing walls 12*e*, 13*e*) and the bottom wall (the first dividing walls 12*d*, 13*d*). The peripheral wall is formed to have a cylindrical shape to generate a swirling flow of refrigerant in the oil separation chamber 41.

A discharge hole 31*a* is formed in the third dividing wall 12*f*, which forms a part of the peripheral wall of the oil separation chamber 41. The discharge hole 31*a* connects the discharge chamber 31 and the oil separation chamber 41 to each other. A discharge passage 41*a* is formed in center portions of the second dividing walls 12*e*, 13*e*, which forms the upper wall of the oil separation chamber 41. The discharge passage 41*a* connects the oil separation chamber 41 and the muffler chamber 40 to each other. The discharge chamber 31 and the muffler chamber 40 are connected to each other via the oil separation chamber 41, so that refrigerant delivered to the discharge chamber 31 is then discharged to the muffler chamber 40 via the oil separation chamber 41.

In the housing, the auxiliary oil reservoir chamber 42 is arranged beside the oil separation chamber 41, that is, at position spaced from the oil separation chamber 41 in a direction perpendicular to the direction of gravity (the vertical direction), and also above the bottom of the oil separation chamber 41. The auxiliary oil reservoir chamber 42 is defined by combining the fixed base plate 14 of the center housing member 12, the first annular wall 12*c*, the first dividing wall 12*d*, the fourth dividing wall 12*g*, the second dividing wall 12*e*, the bottom 13*a* of the rear housing member 13, the second annular wall 13*c*, the first dividing wall 13*d*, the fourth dividing wall 13*g*, and the second dividing wall 13*e*.

Thus, the fourth dividing walls 12*g*, 13*g*, which form the auxiliary oil reservoir chamber 42, also form the peripheral wall of the oil separation chamber 41. A part of the auxiliary oil reservoir chamber 42 is defined by the peripheral wall of the oil separation chamber 41. That is, the fourth dividing wall 12*g*, 13*g* function to form both of the oil separation chamber 41 and the auxiliary oil reservoir chamber 42. The oil separation chamber 41 and the auxiliary oil reservoir chamber 42 are adjacent to each other (arranged side-by-side) in a direction perpendicular to the direction of gravity with the fourth dividing walls 12*g*, 13*g* in between.

An introducing passage 43 is formed in the fourth dividing wall 12*g* of the center housing member 12 by making a recess on the end face of the fourth dividing wall 12*g*. The introducing passage 43 connects the oil separation chamber 41 and the auxiliary oil reservoir chamber 42 to each other. An opening of the introducing passage 43 that extends in the direction of the passage is closed by the gasket 50 when the gasket 50 is held between the fourth dividing walls 12*g*, 13*g*. The introducing passage 43 has an inlet 43*a* at one end and an outlet 43*b* at the other end. The inlet 43*a* communicates with a lower portion of the oil separation chamber 41 in the direction of gravity. The outlet 43*b* communicates with a lower portion of the auxiliary oil reservoir chamber 42 at a position higher than the inlet 43*a*. The inlet 43*a* opens to the oil separation chamber 41 on the fourth dividing wall 12*g* (the inner surface of the peripheral wall). The outlet 43*b* opens to the auxiliary oil reservoir chamber 42 on the fourth dividing wall 12*g*.

Due to the pressure difference between the oil separation chamber 41 and the auxiliary oil reservoir chamber 42, lubricant oil that has been separated in the oil separation chamber 41 is introduced to the lower portion of the auxiliary oil reservoir chamber 42 via the introducing passage 43. The cross-sectional area of the introducing passage 43 is smaller than the cross-sectional area of the oil separation chamber 41, which is perpendicular to the direction of gravity.

In the housing, the main oil reservoir chamber 44 is located below the discharge chamber 31, the oil separation chamber 41, and the auxiliary oil reservoir chamber 42 in the direction of gravity. In the auxiliary oil reservoir chamber 42, the first dividing wall 12*d* of the center housing member 12 and the first dividing wall 13*d* of the rear housing member 13 form the bottom wall of the auxiliary oil reservoir chamber 42 and the upper wall of the main oil reservoir chamber 44. As shown in FIG. 2(*b*), a drain port 45 is formed in a part of the first dividing wall 13*d* of the rear housing member 13 that forms the bottom wall of the auxiliary oil reservoir chamber 42. The drain port 45 is formed by making a recess in the end face of the first dividing wall 13*d* and connects the auxiliary oil reservoir chamber 42 and the main oil reservoir chamber 44 to each other. An opening of the drain port 45 that extends in the direction of the passage is closed by the gasket 50 when the gasket 50 is held between the first dividing walls 12*d*, 13*d*. The cross-sectional area of the drain port 45 is smaller than the cross-sectional area of the auxiliary oil reservoir chamber 42 and the main oil reservoir chamber 44, which is perpendicular to the direction of gravity.

As shown in FIG. 4, the introducing passage 43 and the drain port 45, which communicate with the auxiliary oil reservoir chamber 42, are on the other sides of the gasket 50, namely, on the side corresponding to the center housing member 12 and the side corresponding to the rear housing member 13, respectively. The auxiliary oil reservoir chamber 42 is divided into an introduction chamber 42*a* corresponding to the outlet 43*b* and a drain chamber 42*b* corresponding to the drain port 45 by a dividing portion 50*a*, which is formed by the gasket 50. Conventionally, a hole is formed in the gasket 50 to open the entire auxiliary oil reservoir chamber 42. The dividing portion 50*a* is formed by reducing the size of that hole so that only an upper portion of the auxiliary oil reservoir chamber 42 is open. The dividing portion 50*a* has a height that is approximately half the height of the auxiliary oil reservoir chamber 42 in the direction of gravity. A communication portion 42*c* for connecting the introduction chamber 42*a* and the drain chamber 42*b* to each other is formed between the upper edge of the dividing portion 50*a* and the upper wall of the auxiliary oil reservoir chamber 42.

Operation of the scroll compressor 10 will now be described with reference to FIGS. 3 and 4.

Refrigerant that has been compressed by the compressing portion C is discharged to an upper portion of the oil separation chamber 41 from the discharge chamber 31 via the discharge hole 31*a*, and then swirls from the upper portion toward the lower portion along the peripheral wall of the oil separation chamber 41. The swirling causes lubricant oil contained in the refrigerant to collect on the peripheral wall of the oil separation chamber 41 to be separated from the refrigerant. The refrigerant, from which lubricant oil has been removed in the oil separation chamber 41, is delivered to the muffler chamber 40 via the discharge passage 41*a*, and discharged to the outside of the scroll compressor 10 via the outlet hole 13*b*.

Lubricant oil collected on the peripheral wall of the oil separation chamber 41 reaches the inlet 43*a* of the introducing passage 43 opening in the inner surface of the peripheral wall, and is then drawn to the lower portion of the auxiliary oil reservoir chamber 42 via the introducing passage 43 due to the pressure difference between the oil separation chamber 41 and the auxiliary oil reservoir chamber 42. At this time, since the cross-sectional area of the introducing passage 43 is smaller than the cross-sectional area of the oil separation chamber 41, the flow of the lubricant oil is throttled by the introducing passage 43 when passing therethrough, and the pressure is reduced. Also, since the inlet 43*a* of the introducing passage 43 is located below the outlet 43*b* of the introducing passage 43 in the direction of gravity, lubricant oil that is introduced to the auxiliary oil reservoir chamber 42 is drawn upward toward the auxiliary oil reservoir chamber 42 by the introducing passage 43.

After introduced to the auxiliary oil reservoir chamber 42 from the oil separation chamber 41 via the introducing passage 43, lubricant oil is then introduced to the introduction chamber 42*a* from the outlet 43*b*. Since the position of the outlet 43*b* is lower than the upper end of the dividing portion 50*a*, lubricant oil is blocked by the dividing portion 50*a* to be temporarily retained in the introduction chamber 42*a*. Thereafter, when the lubricant oil retained in the introduction chamber 42*a* overflows, the lubricant oil flows to the drain chamber 42*b* via the communication portion 42*c*.

After reaching the drain chamber 42*b*, lubricant oil flows to the main oil reservoir chamber 44 via the drain port 45 under its own weight. The cross-sectional area of the drain port 45 is smaller than the cross-sectional area of the auxiliary oil reservoir chamber 42 and the main oil reservoir chamber 44. The flow of the lubricant oil is therefore throttled by the drain port 45 when passing therethrough, and the pressure is reduced.

The lubricant oil that has been separated in the oil separation chamber 41 is delivered to the main oil reservoir chamber 44 while its flow velocity (or momentum) is reduced by passing through the introducing passage 43, the auxiliary oil reservoir chamber 42, and the drain port 45. Thereafter, the lubricant oil in the main oil reservoir chamber 44 is supplied to the suction chamber 30 via the introducing passage 12*h*.

The above embodiment has the following advantage.

(1) The oil separation chamber 41 is located in the housing, and the auxiliary oil reservoir chamber 42 is located beside and adjacent to the oil separation chamber 41. A part of the auxiliary oil reservoir chamber 42 is formed by the fourth dividing walls 12*g*, 13*g*, which form the peripheral wall of the oil separation chamber 41. Further, the introducing passage 43 for connecting the oil separation chamber 41 and the auxiliary oil reservoir chamber 42 to each other is formed in the fourth dividing wall 12*g*, such that the inlet 43*a* of the introducing passage 43 opens in the inner surface of the peripheral wall of the oil separation chamber 41. This allows lubricant oil flowing down along the peripheral wall of the oil separation chamber 41 to be introduced to the auxiliary oil reservoir chamber 42 from the inlet 43*a* via the introducing passage 43, without flowing on the bottom wall of the oil separation chamber 41. Therefore, compared to a case in which lubricant oil in the oil separation chamber 41 flows along the bottom wall of the oil separation chamber 41, the lubricant oil is quickly introduced to the auxiliary oil reservoir chamber 42 to be less likely to be carried away from the oil separation chamber 41 by refrigerant. In other words, lubricant oil can be reliably separated from refrigerant.

(2) In the housing, the auxiliary oil reservoir chamber 42 is located beside the oil separation chamber 41, and the oil separation chamber 41 and the auxiliary oil reservoir chamber 42 are connected to each other by the introducing passage 43. Also, the main oil reservoir chamber 44 is located below the auxiliary oil reservoir chamber 42, and the auxiliary oil reservoir chamber 42 and the main oil reservoir chamber 44 are connected to each other by the drain port 45. The momentum of lubricant oil that has been separated in the oil separation chamber 41 is suppressed since the lubricant oil passes through the introducing passage 43 and is temporarily retained in the auxiliary oil reservoir chamber 42. Also, since the lubricant oil flows through the drain port 45, the momentum of the lubricant oil is further suppressed so that the momentum of the lubricant oil is almost eliminated before reaching the main oil reservoir chamber 44. In addition, since the auxiliary oil reservoir chamber 42 and the main oil reservoir chamber 44 are separated spaces, the oil surface in the main oil reservoir chamber 44 is not disturbed when lubricant oil is introduced to the auxiliary oil reservoir chamber 42. Therefore, the oil surface in the main oil reservoir chamber 44 is prevented from being disturbed. This prevents refrigerant in gaseous state from being supplied to suction chamber 30, so that lubricant oil is steadily supplied to the suction chamber 30.

(3) In the oil separation chamber 41, refrigerant swirls from the top to bottom along the peripheral wall, and the swirling motion causes lubricant oil to flow along the peripheral wall of the oil separation chamber 41. Since lubricant oil is directed to the inlet 43*a* of the introducing passage 43 by the swirling motion of the refrigerant, no additional member is required for guiding separated lubricant oil to the introducing passage 43.

(4) Lubricant oil that has been separated in the oil separation chamber 41 is introduced to the auxiliary oil reservoir chamber 42 via the introducing passage 43, and then flows to the main oil reservoir chamber 44 via the drain port 45. Thus, the flow of lubricant oil is throttled twice by passing through the introducing passage 43 and the drain port 45 when flowing from the oil separation chamber 41 to the main oil reservoir chamber 44. Therefore, when the lubricant oil reaches the main oil reservoir chamber 44, the momentum of the lubricant oil is reduced.

(5) The oil separation chamber 41 and the auxiliary oil reservoir chamber 42 are connected to each other by the introducing passage 43. The inlet 43*a* of the introducing passage 43 is formed to be located in a lower portion of the oil separation chamber 41, and the outlet 43*b* of the introducing passage 43 is located above the inlet 43*a* and in a lower portion of the auxiliary oil reservoir chamber 42. Thus, the lubricant oil in the oil separation chamber 41 is drawn upward to the auxiliary oil reservoir chamber 42 against the force of gravity, which reduces the momentum of the flow of the lubricant oil. Therefore, when the lubricant oil is introduced to the auxiliary oil reservoir chamber 42, the oil surface in the auxiliary oil reservoir chamber 42 is not disturbed.

(6) Further, the outlet 43*b* of the introducing passage 43 is formed in a lower portion of the auxiliary oil reservoir chamber 42. Therefore, lubricant oil is prevented from dribbling onto the surface of the oil retained in the auxiliary oil reservoir chamber 42, so that the oil surface in the auxiliary oil reservoir chamber 42 is not disturbed.

(7) The auxiliary oil reservoir chamber 42 is divided into the introduction chamber 42*a* corresponding to the outlet 43*b* of the introducing passage 43 and the drain chamber 42*b* corresponding to the drain port 45 by the dividing portion 50*a*, and the communication portion 42*c* connects the introduction chamber 42*a* and the drain chamber 42*b* to each other. Therefore, lubricant oil introduced to the auxiliary oil reservoir chamber 42 from the oil separation chamber 41 is blocked by the dividing portion 50*a* and temporarily retained in the introduction chamber 42*a*. This eliminates substantially all the momentum of the flow of lubricant oil.

(8) When the lubricant oil retained in the introduction chamber 42*a* overflows, the lubricant oil flows out from the introduction chamber 42*a* to the drain chamber 42*b* via the communication portion 42*c*. Thus, the lubricant oil supplied to the drain chamber 42*b* has no momentum, so that the oil surface in the drain chamber 42*b* is not disturbed. Since lubricant oil flows from the drain chamber 42*b*, in which the oil surface is stable, to the main oil reservoir chamber 44, the oil surface in the main oil reservoir chamber 44 is not disturbed.

(9) The dividing portion 50*a*, which divides the auxiliary oil reservoir chamber 42 into the introduction chamber 42*a* and the drain chamber 42*b*, is formed by the gasket 50. The gasket 50 is held by the center housing member 12 and the rear housing member 13 to seal the chambers 31, 40, 41, 42, 44. Since the dividing portion 50*a* is formed by the gasket 50, which is indispensable to the scroll compressor 10, no dividing portion needs to be formed integrally with the auxiliary oil reservoir chamber 42, so that the dividing portion 50*a* is formed easily.

(10) The dividing portion 50*a*, which divides the auxiliary oil reservoir chamber 42 into the introduction chamber 42*a* and the drain chamber 42*b*, is formed by the gasket 50. Thus, the height of the dividing portion 50*a* can be easily adjusted simply by machining the gasket 50.

(11) The oil separation chamber 41, the auxiliary oil reservoir chamber 42, and the main oil reservoir chamber 44 are each formed by combining parts of these chambers 41, 42, 44 formed in the center housing member 12 and the rear housing member 13. Therefore, the chambers 41, 42, 44 are each formed across the housing members 12, 13. Thus, compared to a case in which the chambers 41, 42, 44 are each formed only in, for example, the rear housing member 13, large volumes of the chambers 41, 42, 44 are ensured.

(12) The compressor 10 includes the scroll-type compressing portion C. The suction chamber 30 of the scroll-type compressing portion C is not located on the side of the compressing portion C closer to the rear housing member 13, but in a radially outer portion of the compressing portion C. Therefore, the oil separation chamber 41, the auxiliary oil reservoir chamber 42, and the main oil reservoir chamber 44 can be arranged on a side of the compressing portion C that is closer to the rear housing member 13 in the axial direction of the compressor 10 (the axial direction of the rotary shaft 17).

The above described embodiment may be modified as follows.

In the illustrated embodiment, the oil separation chamber 41, the auxiliary oil reservoir chamber 42, and the main oil reservoir chamber 44 are each formed across the center housing member 12 and the rear housing member 13. However, each of the chambers 41, 42, 44 may be formed in one of the rear housing member 13 and the center housing member 12.

In the illustrated embodiment, the dividing portion 50*a* is formed by the gasket 50. However, the dividing portion 50*a* does not necessarily need to be formed by the gasket 50. Instead, a dividing portion may be directly formed on the center housing member 12 or the rear housing member 13. Alternatively, a member different from the gasket 50 may be used to form a dividing portion.

In the illustrated embodiment, the auxiliary oil reservoir chamber 42 is divided into the introduction chamber 42*a* and the drain chamber 42*b*. However, the auxiliary oil reservoir chamber 42 does not necessarily need to be divided.

In the illustrated embodiment, the introducing passage 43 is formed such that the inlet 43*a* is located in a lower portion of the oil separation chamber 41, and the outlet 43*b* is located above the inlet 43*a* and in a lower portion of the auxiliary oil reservoir chamber 42. However, the structure of the introducing passage 43 may be changed. For example, as long as the inlet 43*a* is formed in the peripheral wall of the oil separation chamber 41, the position of the inlet 43*a* may be changed as needed. For example, the inlet 43*a* may be formed in an upper portion of the oil separation chamber 41.

In the illustrated embodiment, the compressing portion C is a scroll type compressing portion. However, the compressing portion C may be a vane type compressing portion.

The invention claimed is:

1. A compressor comprising:

a compressing portion that is located in a housing to compress refrigerant;

an oil separation chamber to which refrigerant is introduced from the compressing portion, wherein the oil separation chamber has a peripheral wall for causing refrigerant to swirl to separate lubricant oil mixed in the refrigerant; and an auxiliary oil reservoir chamber and a main oil reservoir chamber that retain lubricant oil that is separated from refrigerant, wherein a part of the auxiliary oil reservoir chamber is defined by the peripheral wall of the oil separation chamber, and an introducing passage for introducing lubricant oil in the oil separation chamber to the auxiliary oil reservoir chamber is formed in the peripheral wall, the introducing passage has an inlet located at one end and an outlet located at the other end, the inlet of the introducing passage opens to the oil separation chamber on an inner surface of the peripheral wall, and the outlet of the introducing passage opens to the auxiliary oil reservoir chamber, wherein the inlet of the introducing passage is located at a lower part of the oil separation chamber in the direction of gravity, and the outlet of the introducing passage is located above the inlet of the introducing passage in the direction of gravity and at a lower part of the auxiliary oil reservoir chamber in the direction of gravity, and the main oil reservoir chamber is located below the auxiliary oil reservoir chamber in the direction of gravity, wherein a drain port is formed in a bottom wall of the auxiliary oil reservoir chamber, the drain port drains lubricant oil in the auxiliary oil reservoir chamber to the main oil reservoir chamber, and lubricant oil in the main oil reservoir chamber is supplied to a suction-side structure of the compressing portion.

2. The compressor according to claim 1, wherein the auxiliary oil reservoir chamber is divided by a dividing portion into an introduction chamber, which corresponds to the outlet of the introducing passage, and a drain chamber, which corresponds to the drain port, and the introduction chamber and the drain chamber are connected to each other by a communication portion, which is located above the dividing portion in the direction of gravity.

3. The compressor according to claim 2, wherein the auxiliary oil reservoir chamber is formed by coupling a plurality of housing forming members, and a gasket is held between the housing forming members, and the dividing portion is formed by the gasket.

4. The compressor according to claim 3, wherein the oil separation chamber and the main oil reservoir chamber are formed by coupling the housing forming members.

5. The compressor according to claim 1, wherein the compressing portion is of a scroll type.

* * * * *